US007373678B2

(12) United States Patent
Hetzel et al.

(10) Patent No.: US 7,373,678 B2
(45) Date of Patent: May 20, 2008

(54) SEAT CUSHION WITH ADJUSTABLE CONTOUR AND METHOD OF ADJUSTING THE CONTOUR OF A SEAT CUSHION

(75) Inventors: Thomas R. Hetzel, Littleton, CO (US); Joseph S. Bieganek, Littleton, CO (US); Steve Maurus, Littleton, CO (US)

(73) Assignee: Aspen Seating, LLC, Sheridan, CO (US)

( * ) Notice: Subject to any disclaimer, the term of this patent is extended or adjusted under 35 U.S.C. 154(b) by 281 days.

(21) Appl. No.: 11/140,003

(22) Filed: May 27, 2005

(65) Prior Publication Data

US 2005/0235423 A1 Oct. 27, 2005

Related U.S. Application Data

(63) Continuation-in-part of application No. 10/628,860, filed on Jul. 28, 2003, now Pat. No. 7,216,388.

(51) Int. Cl.
*A47C 7/20* (2006.01)
*B68G 5/00* (2006.01)

(52) U.S. Cl. ..... 5/653; 5/655.4; 29/91.1; 297/452.26

(58) Field of Classification Search ..... 5/653, 5/654, 654.1, 655.4, 655.9, 652, 656, 739; 297/452.23, 452.26, 452.27, 452.28; 29/91, 29/91.1

See application file for complete search history.

(56) References Cited

U.S. PATENT DOCUMENTS

| | | | |
|---|---|---|---|
| D59,900 | S | 12/1921 | Marsh |
| 1,742,183 | A | 1/1930 | Claus |
| 1,961,641 | A | 6/1934 | Ollis |
| 2,156,629 | A | 5/1939 | Hutchison |
| 2,384,713 | A | 9/1945 | Varma |
| D169,366 | S | 4/1953 | Feldman |

(Continued)

FOREIGN PATENT DOCUMENTS

| | | |
|---|---|---|
| FR | 768163 | 8/1934 |

OTHER PUBLICATIONS

UK Patent Application GB2 016 918 A, Oct. 3, 1979.

(Continued)

*Primary Examiner*—M. Safavi
(74) *Attorney, Agent, or Firm*—John R. Ley

(57) ABSTRACT

A flexible support structure of a seat cushion, such as a wheelchair cushion, has an upper surface with a support contour having relief areas for establishing relatively less pressure on skin adjacent to bony prominences of a user's pelvis and having a support area for establishing relatively more pressure on skin covering a tissue mass spaced from the bony prominences. A slit is formed in the rear corner of the support structure and an insertion member is inserted into the slit to change a position of the support area to thereby adjust the support contour for better support of the pelvic area. A cover encases the support structure to resist outward deformation of the support structure. The cover has an extension portion that expands the cover at the rear corner to increase a dimension of the cover to encase an increase dimension of the corner caused by the insertion of the insertion member.

16 Claims, 14 Drawing Sheets

U.S. PATENT DOCUMENTS 2,659,418 A 11/1953 Berman
2,785,440 A * 3/1957 Toulmin, Jr. ..... 29/91
2,837,145 A * 6/1958 Goetz ..... 5/652
2,933,738 A 4/1960 Whelan
3,158,878 A 12/1964 Pernell
3,177,036 A 4/1965 Halter
3,222,694 A 12/1965 Schick
3,511,537 A 5/1970 Ackermann
3,749,442 A 7/1973 Berg et al.
D238,235 S 12/1975 Elgebrandt
3,987,507 A 10/1976 Hall
4,132,228 A 1/1979 Green
4,327,046 A 4/1982 Davis et al.
4,347,213 A 8/1982 Rogers, Jr.
D278,779 S 5/1985 Sink
4,522,447 A 6/1985 Snyder et al.
4,567,887 A 2/1986 Couch, Jr.
4,588,229 A 5/1986 Jay
4,615,856 A 10/1986 Silverman
4,643,481 A 2/1987 Saloff et al.
D289,481 S 4/1987 Reddick
4,682,818 A 7/1987 Morell
4,726,624 A 2/1988 Jay
4,753,480 A 6/1988 Morell
4,756,090 A 7/1988 Pedrow
4,824,174 A 4/1989 Dunn, Sr.
4,834,458 A * 5/1989 Izumida et al. ..... 297/452.23
4,842,330 A 6/1989 Jay
4,853,993 A * 8/1989 Walpin et al. ..... 5/634
4,889,387 A 12/1989 Gregory
4,890,235 A 12/1989 Reger et al.
4,912,788 A 4/1990 Lonardo
4,951,334 A 8/1990 Maier
4,972,351 A 11/1990 Reger et al.
4,998,354 A 3/1991 Silverman et al.
5,018,790 A 5/1991 Jay
D318,923 S 8/1991 Marsh
5,079,790 A 1/1992 Pouch
5,092,655 A 3/1992 Deegener et al.
5,133,116 A * 7/1992 Wagner et al. ..... 29/91
5,137,333 A * 8/1992 Chee ..... 297/452.21
5,163,737 A 11/1992 Navach et al.
5,180,619 A 1/1993 Landi et al.
5,189,747 A 3/1993 Mundy et al.
5,193,285 A 3/1993 Heinrich et al.
D335,235 S 5/1993 Hildreth
5,255,404 A 10/1993 Dinsmoor, III et al.
D342,411 S 12/1993 Graebe
5,282,286 A 2/1994 MacLeish
5,288,135 A 2/1994 Forcier et al.
5,294,181 A 3/1994 Rose et al.
5,317,773 A 6/1994 Graebe
5,333,921 A 8/1994 Dinsmoor, III
5,343,876 A 9/1994 Rogers
5,352,023 A 10/1994 Jay et al.
5,369,829 A 12/1994 Jay
5,378,045 A 1/1995 Siekman et al.
5,390,384 A 2/1995 Dinsmoor, III et al.
5,395,162 A 3/1995 Jay et al.
5,397,517 A 3/1995 Jay et al.
5,414,884 A 5/1995 Mackenzie
5,442,823 A 8/1995 Siekman et al.
5,444,881 A 8/1995 Landi et al.
5,452,940 A 9/1995 Maier
5,457,833 A 10/1995 Jay
5,461,741 A 10/1995 Graebe
5,470,590 A 11/1995 Brubaker et al.
5,490,299 A 2/1996 Dinsmoor, III et al.
5,496,610 A 3/1996 Landi et al.
5,513,899 A 5/1996 Michaels et al.
5,522,106 A 6/1996 Harrison et al.
5,524,971 A 6/1996 Jay et al.
5,551,107 A 9/1996 Graebe
5,551,756 A 9/1996 Gurasich et al.
5,592,707 A 1/1997 Dinsmoor, III et al.
5,613,256 A 3/1997 Hanson
5,613,257 A 3/1997 Graebe
5,617,595 A 4/1997 Landi et al.
5,657,499 A * 8/1997 Vaughn et al. ..... 5/654
5,671,977 A 9/1997 Jay et al.
5,681,092 A 10/1997 Hanson et al.
5,687,436 A 11/1997 Denton
5,714,108 A * 2/1998 Girardi et al. ..... 264/331.17
5,749,111 A * 5/1998 Pearce ..... 5/652
5,836,025 A 11/1998 Poncy, Sr.
5,840,400 A 11/1998 Landi et al.
5,845,352 A 12/1998 Matsler et al.
5,920,915 A 7/1999 Bainbridge et al.
6,018,832 A 2/2000 Graebe
6,032,300 A 3/2000 Bainbridge et al.
6,055,676 A 5/2000 Bainbridge et al.
6,082,824 A 7/2000 Chow
6,161,238 A 12/2000 Graebe
6,182,314 B1 2/2001 Frydman
6,241,320 B1 6/2001 Chew et al.
6,293,026 B1 9/2001 Lee et al.
6,293,625 B1 9/2001 Dixon
6,301,722 B1 10/2001 Nickerson et al.
6,345,401 B1 2/2002 Frydman
6,357,054 B1 3/2002 Bainbridge et al.
6,453,477 B1 9/2002 Bainbridge et al.
6,493,958 B1 12/2002 Tadin
6,502,263 B1 1/2003 Rowley et al.
6,505,650 B2 1/2003 Bohon et al.
6,611,980 B2 9/2003 Wempe
6,625,897 B2 9/2003 Tadin
6,694,554 B2 * 2/2004 Bullard ..... 5/655.8
6,755,475 B1 * 6/2004 Tiesler et al. ..... 297/452.26
6,848,136 B2 * 2/2005 Sonobe ..... 5/655.9
2001/0013146 A1 8/2001 Wempe
2002/0014794 A1 2/2002 Chow
2003/0121103 A1 7/2003 Wempe
2005/0022305 A1 2/2005 Bleganek et al.
2005/0022306 A1 2/2005 Hetzel et al.
2005/0022406 A1 2/2005 Bieganek et al.
2005/0023872 A1 2/2005 Hetzel et al.
2005/0025953 A1 2/2005 Hetzel et al.

OTHER PUBLICATIONS

PCT International Search Report for International Application No. PCT/US2004/024180, dated Nov. 19, 2004.

* cited by examiner

SEAT CUSHION WITH ADJUSTABLE CONTOUR AND METHOD OF ADJUSTING THE CONTOUR OF A SEAT CUSHION

CROSS-REFERENCE TO RELATED APPLICATIONS

This invention is a continuation in part of U.S. patent application Ser. No. 10/628,860, filed Jul. 28, 2003 now U.S. Pat No. 7,216,388, for a Contoured Seat Cushion and Method for Offloading Pressure from Skeletal Bone Prominences and Encouraging Proper Postural Alignment. This invention is also related to other inventions made by at least one of the inventors herein for Individually-Contoured Seat Cushion and Shape Capturing and Fabricating Method for Seat Cushion described in U.S. patent application Ser. No. 10/628,858, and for Modular Seat Cushion with Interlocking Human Support and Base Portions and Method of Creating and Using a Seat Cushion described in U.S. patent application Ser. No. 10/628,859, and for Apparatus and Method for Evaluating Clearance from a Contoured Seat Cushion described in U.S. patent application Ser. No. 10/628,890, filed on Jul. 28, 2003, and for Reinforcing and Adjustable Contoured Seat Cushion and Method of Reinforcing and Adjusting the Contoured Seat Cushion described in U.S. patent application Ser. No. 10/766,623 which was filed on Jan. 28, 2004, all of which are assigned to the assignee of the present invention. The subject matter of these applications is incorporated herein by reference.

FIELD OF THE INVENTION

This invention relates to seat cushions, and more particularly, to a new and improved seat cushion having an adjustable support contour that provides a range of users with a proper orientation of posture while reducing or eliminating the incidence of pressure ulcers. The support contour offloads or isolates pressure and shear forces from skin tissue surrounding the bony prominences of the pelvic skeletal bone structure, such as the ischial tuberosities, greater trochanters, coccyx and sacrum, thereby removing pressure and shear forces from those areas which are susceptible to injury from prolonged sitting. Proper postural alignment is achieved by transferring the pressure from the offloaded areas to greater masses of tissue not associated with bony prominences, such as the proximal thighs and the posterior lateral buttocks. The additional support from these areas encourages improved postural alignment and control.

BACKGROUND OF THE INVENTION

A wheelchair seat cushion must perform a number of important functions. The seat cushion should be comfortable and capable of providing proper support for optimal posture and posture control for a considerable length of time. The seat cushion should also assist, or at least not materially hinder, the user in maneuvering the wheelchair, permit a useful range of motion from the pelvis and upper torso of the person, and create stability and security for the person within the wheelchair. Perhaps most importantly, the seat cushion should help prevent and reduce the incidence of pressure ulcers created by prolonged sitting on the cushion without adequate pressure relief. Pressure ulcers can become a very serious health problem for individuals who must remain constantly in contact with the support cushion, and it is important to avoid such pressure ulcers.

Wheelchair users, like everyone, are of substantially different sizes, weights and shapes. Many wheelchair users have physical disabilities and associated posture and postural control impairments such as those typically caused by congenital disorders. Other wheelchair users, such as those who have been disabled by acquired or traumatic injuries, may have a more typical size and shape. In all of these cases, the support contour of the wheelchair seat cushion must safely support the anatomy of the user, whether the anatomy is abnormal or more typical. Wheelchair seat cushions must fit and perform properly to prevent further physical impairment and pressure ulcers. The cushion must also enhance the functional capabilities of the user by supporting independence in activities of daily living. There are a number of different theories or approaches for configuring the support contour of a wheelchair seat cushion to avoid pressure ulcers and to provide adequate postural alignment.

One approach to configuring the support contour of a wheelchair seat cushion is a single generic support contour which attempts to accommodate all types of pelvic bone-structure configurations, whether more abnormal or more typical. In general, this generic approach involves using a soft, flowable or adaptable material, such as air or gel, as the support material within the wheelchair cushion. This adaptable material adjusts and redistributes in response to the weight and shape of the user to create a support contour which conforms to the anatomy of the user. By conforming to the anatomy of the user, the pressure on the skin of the user is usually distributed relatively evenly over the area of contact. The extent of the uniform pressure distribution depends on the capability of the cushion to accept and conform to the user's anatomy without displacing the adaptable material and resulting in firm contact with a support structure.

The substantially equal pressure distribution is theorized to reduce the incidence of pressure ulcers, by decreasing peak pressures on the skin in the pelvic area associated with bony prominences, most notably the ischial tuberosities, coccyx, sacrum, and greater trochanters. However, as individuals age with their disabilities, the quality of their skin is further compromised in its ability to tolerate pressure and shear forces. The decreased tolerance for pressure and shear forces, no matter how well those forces are distributed, increases the incidence of pressure ulcers.

Generic seat cushions which use flowable support material are usually incapable of providing adequate postural alignment. In general terms, adequate postural alignment is assisted by using the support contour of the seat cushion to encourage proper posture by providing a foundation for dynamic posture control. To do so, the support contour must have the capability of applying some support pressure to the pelvic area because alignment of the pelvic area is fundamental for proper posture. The adaptable support material of generic seat cushions is intended to move and redistribute itself, and consequently, is generally unstable and incapable of applying the support pressure or force in certain areas of the pelvic anatomy to optimize postural control and alignment.

Many of the disadvantages associated with generic wheelchair cushions may be overcome by using a custom wheelchair seat cushion having a support contour constructed specifically to accommodate the individual anatomical aspects of a particular user. In such cases, it is necessary to capture the anatomical shape of the individual which will contact the custom seat cushion, and then use that anatomical shape to make the custom seat cushion.

The cost of fabricating a custom wheelchair seat cushion can be substantial, for example, approximately $3000 or more. Much of the expense of a custom wheelchair seat cushion results from the amount of time consumed, and the cost of the relatively sophisticated equipment which must be used to capture and transfer the anatomical shape of the user into the support contour of the seat cushion. Moreover, despite the use of sophisticated equipment, it is nevertheless difficult to capture the anatomical shape of the user and transfer it into a customized support contour. An appreciation of some of these difficulties in creating customized wheelchair seat cushions is discussed in the above-referenced U.S. patent application Ser. No. 10/628,858.

Even if the support contour of the custom cushion is initially satisfactory to the user, changes in tissue and musculature may dictate changes in the optimal support contour of the custom seat cushion. Tissue will typically atrophy over time, particularly for first-time wheelchair users. Tissue atrophy and other tissue changes alter the pressure distribution over the support contour. Those changes may result in increased pressure on tissues surrounding the bony prominences, thereby ultimately increasing the risks of pressure ulcers. Moreover, as the muscle strength diminishes, the user relies more on the support contour of the seat to hold the proper posture. In doing so, parts of the pelvic anatomy press more directly on certain parts of the support contour as a foundation for postural alignment. The increased pressure from a change in tissue mass and postural alignment increases the pressure and shear forces on the skin in those areas, again increasing the risk of pressure ulcers.

In those types of existing wheelchair cushions having individualized support contours intended to interact with the anatomy of a specific user, slight discrepancies in capturing the shape of the individualized support may be compensated for by adding shims or other additional external support structures to the seat cushion or to a structural base upon which the cushion resides. The addition of shims or other support structures to an individualized support contour is relatively imprecise in achieving the desired effect, and requires considerable time and effort due to the number of trial fittings that are typically required. A similar situation exists with respect to anatomical changes that occur after the individualized cushion has been used for some amount of time. In both circumstances, the support capabilities of the cushion are inhibited by the trial and error approach to correcting for shape-capturing discrepancies and anatomical changes. Furthermore, the added shims and external support structures complicate the use of the cushion, because the added parts must be kept in alignment with the cushion when in use.

In those types of existing wheelchair cushions which establish an individualized or specific support contour, certain areas of the support contour may be subject to excessive deformation of the flexible support material from which the cushion is constructed. The wheelchair cushions must be constructed of material which offers some amount of flexibility or resiliency in order to function adequately as a cushion. The flexible or resilient material is subject to deformation in areas of significant curvature or areas which laterally support the anatomical structure of the user. These areas of the support contour may have generally thinner dimensions than the portions of the seat cushion directly beneath the user, or there is no support from any lateral structure to reinforce these areas because of the seat support structure beneath the cushion. Excessively flexible portions of the wheelchair cushion, or portions which may become excessively flexible through use over time, are usually not capable of providing pelvic orientation and alignment as may be required by the wheelchair user.

Because of these and other deficiencies, seat cushions with inadequate support may be used long past the time when they have become ineffective in providing proper support, either because of the cost associated with replacement of the cushion or the failure of the user to recognize the problem until pressure ulcers or other difficulties appear.

Many of the same considerations applicable to wheelchair seat cushions also apply with varying levels of criticality to other types of seat cushions used in other seating environments and applications. For example, seat cushions used in office environments are required to support the user in a comfortable manner and in a manner which encourages proper posture and without creating risks of medical problems, for example inducing blood circulatory problems.

SUMMARY OF THE INVENTION

The present invention involves adjusting a standard support contour of a seat cushion to address the individual needs of a user and to obtain the best conditions for isolating and offloading pressure and shear forces from the skin surrounding the bony prominences of the pelvic area skeletal structure and for transferring greater pressure and providing firmer support to areas of the anatomy which have broader masses of soft and muscle tissue not surrounding bony prominences. Offloading or isolating the pressure and shear force from the skin surrounding the bony prominences of the pelvic skeletal structure reduces the risk of pressure ulcers. Transferring pressure and providing pronounced support to broad tissue masses encourages better balance and alignment. Greater support pressure is applied to and maintained on those areas which bias, orient or encourage alignment of the pelvic structure toward proper postural alignment. By offloading the pressure and shear forces from those areas which are prone to skin ulcers, and transferring support pressure to those areas which encourage proper postural alignment, the support contour of the seat cushion simultaneously achieves the two most important wheelchair cushion functions: avoidance of pressure ulcers, and postural alignment and control.

The adjustment capability of the support contour also makes the cushion adaptable to a wider range of variations in the size and shape of the normal human anatomy, primarily as a result of the additional clearance in the areas of the bony prominences and the additional support in the areas of broader tissue and muscular masses. The greater relief or clearance in the areas of the bony prominences and the greater support in the areas of broader tissue and muscular mass, makes the support contour generally applicable to classes of individuals having generally similar pelvic anatomies.

These and other features of the present invention are realized in an adjustable contoured seat cushion for supporting a person in a seated position. The seat cushion includes a support structure having a top surface with a support contour, the support contour defining relief areas which are positioned to align with bony prominences of the person and support areas that are positioned to align with skin covering tissue masses spaced from the bony prominences. The seat cushion also includes an insertion member and an opening or slits formed in one or both of the rear corners of the support structure to receive the insertion member. The slits are positioned between the top surface and a bottom surface of the support structure. A support area of the support contour changes position relative to other support areas or relief areas when the insertion member is inserted into one of the slits.

Another aspect of the invention involves a method of manufacturing a resilient seat cushion for supporting a person in a seated position. The method comprises forming a support structure by forming generally opposite front and a rear sides and generally opposite left and right sides. The rear side intersects the left and right sides at rear corners of the support structure. The support structure further includes a bottom surface extending between the front and rear sides and between the left and right sides, and a top surface generally opposite of the bottom surface and extending between the front and rear sides and the left and right sides. The top surface defines a support contour of the support structure which has relief areas and support areas. The relief areas align with the bony prominences of the person when the person is seated on the cushion and the support areas align with skin covering tissue masses spaced from the bony prominences including skin covering a posterior lateral buttocks of the person. The method involves forming an opening or slit in each of the rear corners. Each opening is adapted to receive an insertion member, and when the insertion member is inserted, the support contour is adjusted in a manner to better support the user.

Another aspect of the invention involves a method of adjusting a seat cushion to support a person in a seated position on a resilient support structure of the seat cushion. The method involves inserting an insertion member into an opening in a portion of the support structure.

A further aspect of the present invention involves a seat cushion kit which includes a seat support structure having an upper support contour for supporting a user. The support structure includes a portion having an opening. The kit also includes a cover which encases the support contour to protect the support contour and which resists outward deformation of the support structure. The kit also includes a clearance measuring device for measuring clearance between the user's anatomy and the support contour. The insertion member is inserted into the opening to adjust a position of a support area of the support structure to better support the user.

A more complete appreciation of the scope of the invention and the manner in which it achieves the above-noted and other improvements can be obtained by reference to the following detailed description of presently preferred embodiments taken in connection with the accompanying drawings, which are briefly summarized below, and by reference to the appended claims.

DETAILED DESCRIPTION

Figure 1:
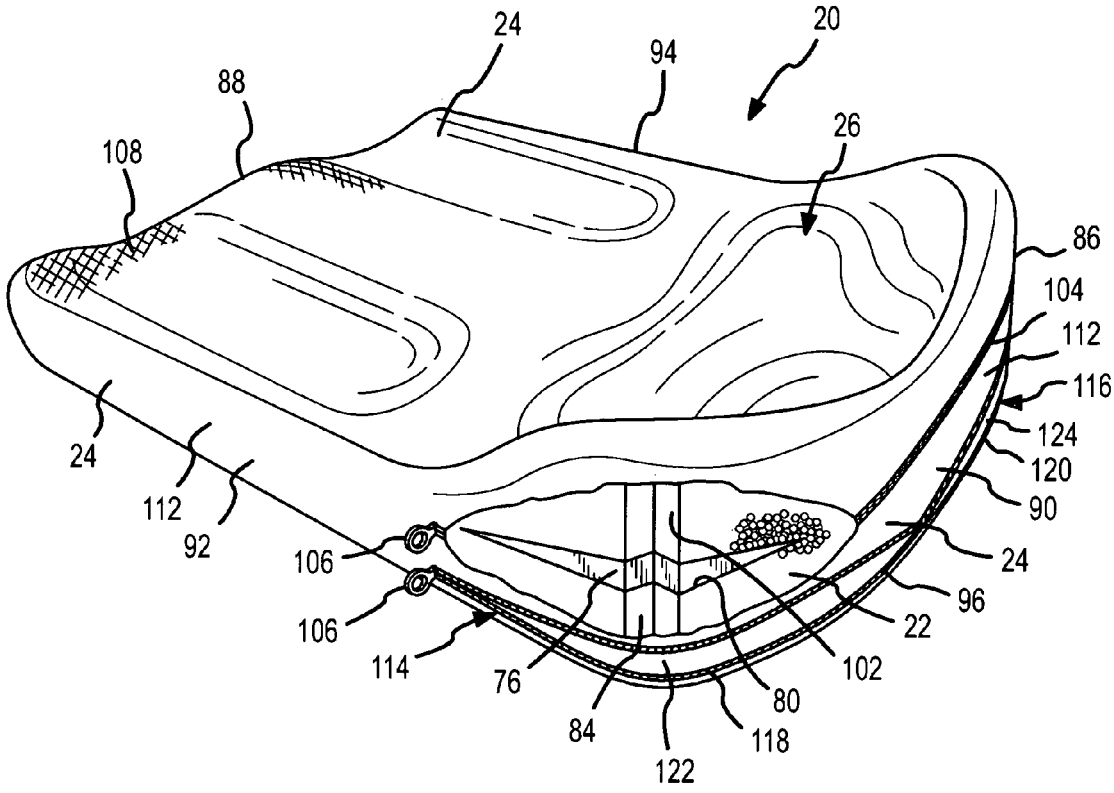
FIG. 1 is an upper perspective view of a contoured wheelchair or other seat cushion which incorporates the present invention, shown with a portion of a cover broken away to reveal a support structure with an insert member positioned in a slit.

A wheelchair seat cushion 20 which incorporates the present invention is shown in FIG. 1. The seat cushion 20 includes a resilient seat support structure 22 which is constructed of resilient plastic foam material and a breathable material cover 24 which together are capable of providing the necessary support to the wheelchair user. A support contour 26 is preferably constructed or otherwise formed as a part of the support structure 22. Preferably, the resilient plastic foam material from which the support structure 22 is formed is a matrix of polypropylene, polyurethane, polyethylene or other plastic beads which have been adhered together during a molding process in which the support contour 26 is formed simultaneously with the support structure 22, as described more completely in the above-referenced U.S. patent application Ser. No. 10/628,858.

Figure 2:
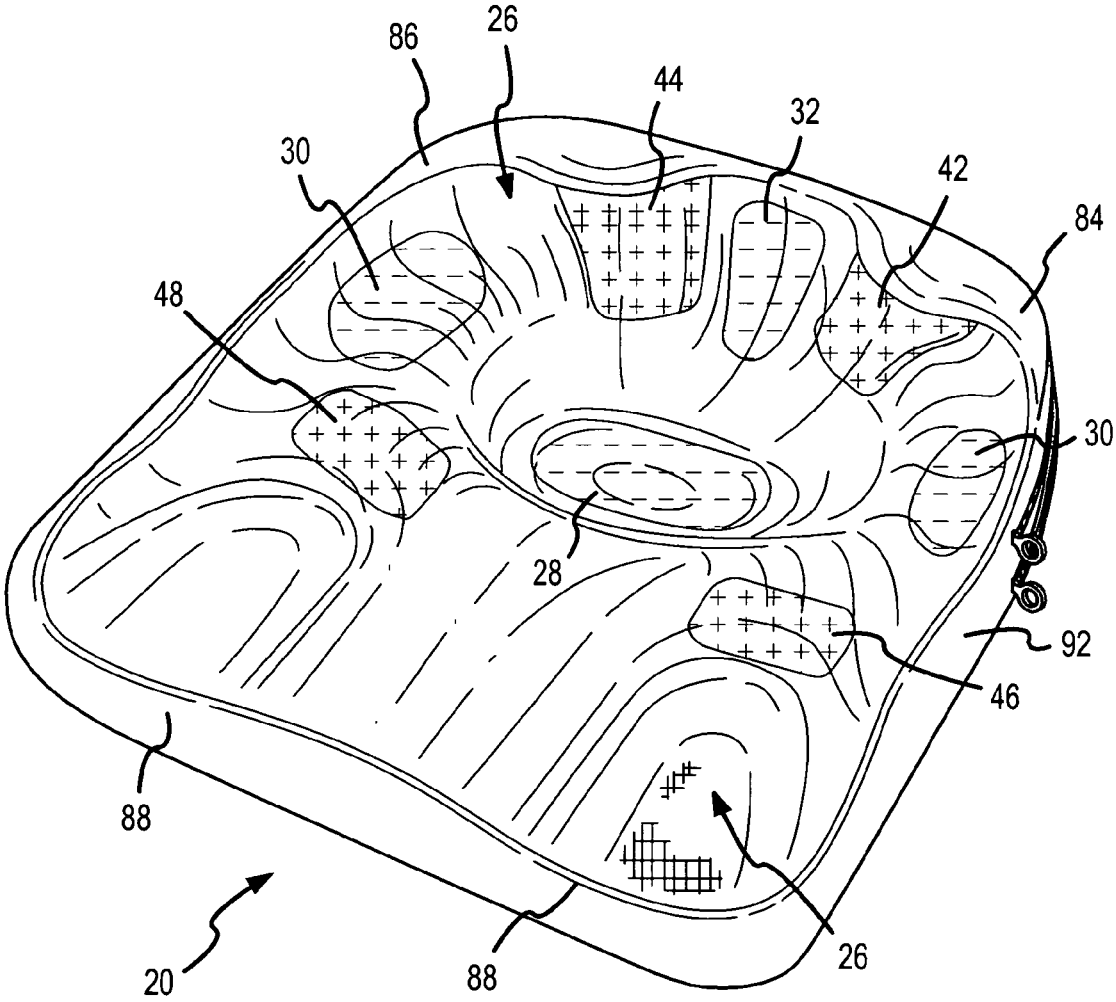
FIG. 2 is a perspective view of the seat cushion shown in FIG. 1, with shading and crosshatching to illustrate areas of the support contour where pressure is offloaded and areas where additional support is provided to support a user.
Figure 3:
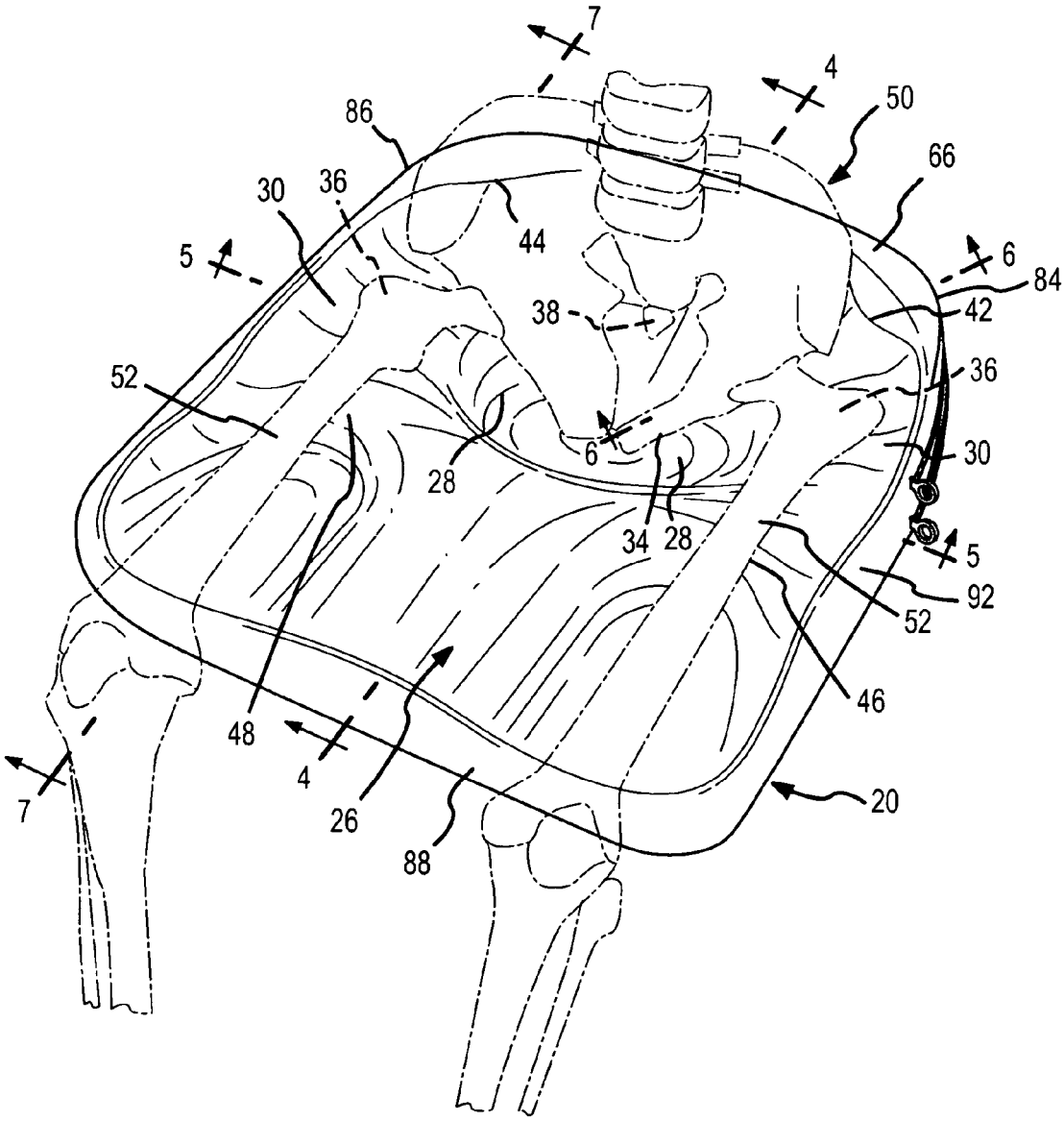
FIG. 3 is a perspective view of the seat cushion shown in FIGS. 1 and 2, showing a typical human pelvic and thigh skeletal structure superimposed over the support contour of the seat cushion.

The support contour 26 is formed, as shown in FIG. 2, with relief areas 28, 30 and 32 which align with skin covering bony prominences of the users pelvic area, as shown in FIG. 3. Clearances between the bony prominences of the ischial tuberosities 34, the greater trochanters 36, and the coccyx 38 and the sacrum 40 and the support contour 26 at the relief areas 28, 30 and 32, respectively, offload pressure and shear forces from the skin surrounding these bony prominences. The support contour 26 is also formed with support areas 42, 44, 46 and 48 which align with anatomical features of the users pelvic area to support the user by contacting the skin over muscular portions of the pelvic area. The support areas 42, 44, 46 and 48 compensate for the increased clearance in the areas 28, 30 and 32, by providing greater protrusion for enhanced support where there are relatively large and broad masses of tissue and muscle upon which the greater pressure can be applied without creating localized pressure points.

Figure 4:
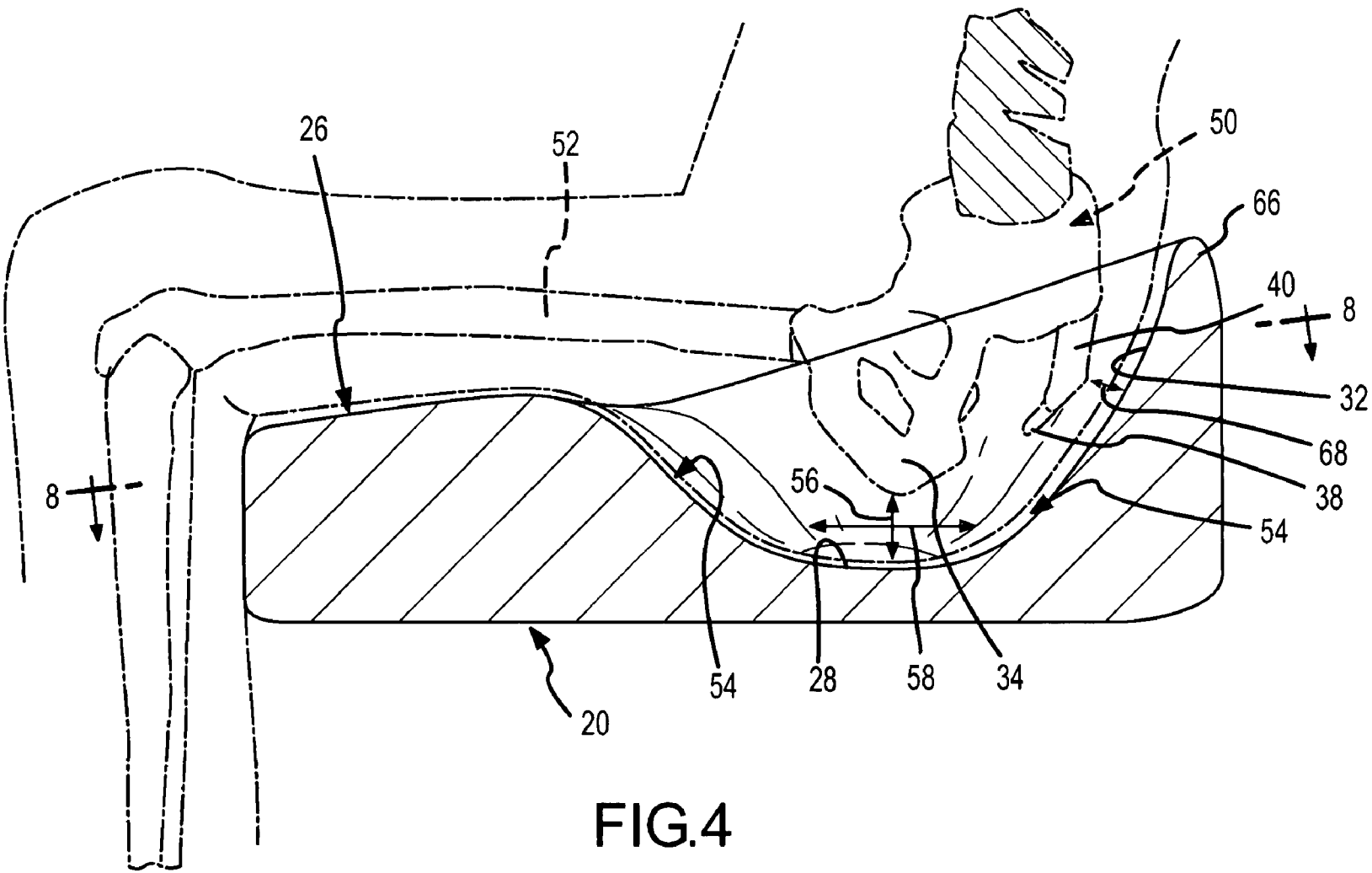
FIG. 4 is a midline longitudinal and vertical cross-sectional view taken substantially in the plane of line 4-4 of FIG. 3.

The support contour 26 faces upward to contact and support the tissues of the user which surround the skeletal structure of the pelvic area 50 and the thigh bones 52 of the user, as shown in FIGS. 2-8. The support contour 26 includes a relatively deep center cavity 54 which is positioned in the support contour 26 to be located directly below ischial tuberosities 34 of the skeletal structure of the pelvic area 50, when the user is seated on the cushion 20, as shown in FIG. 4.

Figure 5:
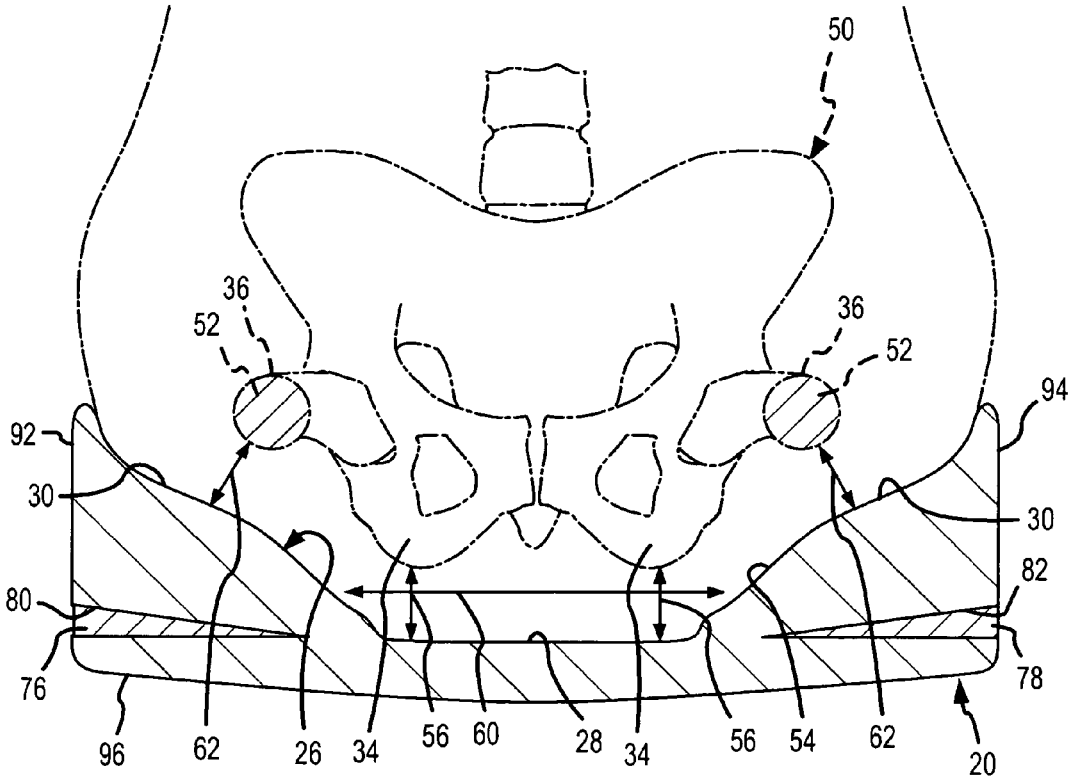
FIG. 5 is a transverse and vertical cross-sectional view taken substantially in the plane of line 5-5 of FIG. 3.

In the support contour 26, the vertical depth and horizontal dimensions of the cavity 54 are sufficient to offload pressure and shear force from the skin surrounding the ischial tuberosities 34. The depth of the cavity 54 is sufficient to establish clearances 56, 58 and 60 between the lower ends of the ischial tuberosities 34 and the lowermost surface area 28, as shown in FIGS. 4 and 5. By offloading the pressure and shear force from the skin surrounding the ischial tuberosities 34 due to the clearances 56, 58 and 60, the risk of pressure ulcers on the skin surrounding the ischial tuberosities 34 is reduced substantially.

The support contour 26 rises from the lowermost surface area 28 on opposite transverse sides of the cavity 54 to the relief areas 30, as shown in FIGS. 2 and 3. The relief areas 30 are positioned directly below and transversely to the outside of the greater trochanters 36 on both transverse sides of the support contour 26, when the user is seated on the cushion 20. The relief areas 30 establish vertical and transverse clearances 62 with respect to the greater trochanters 36 to offload pressure and shear force from the skin surrounding the greater trochanters 36, as shown in FIG. 5.

Figure 8:
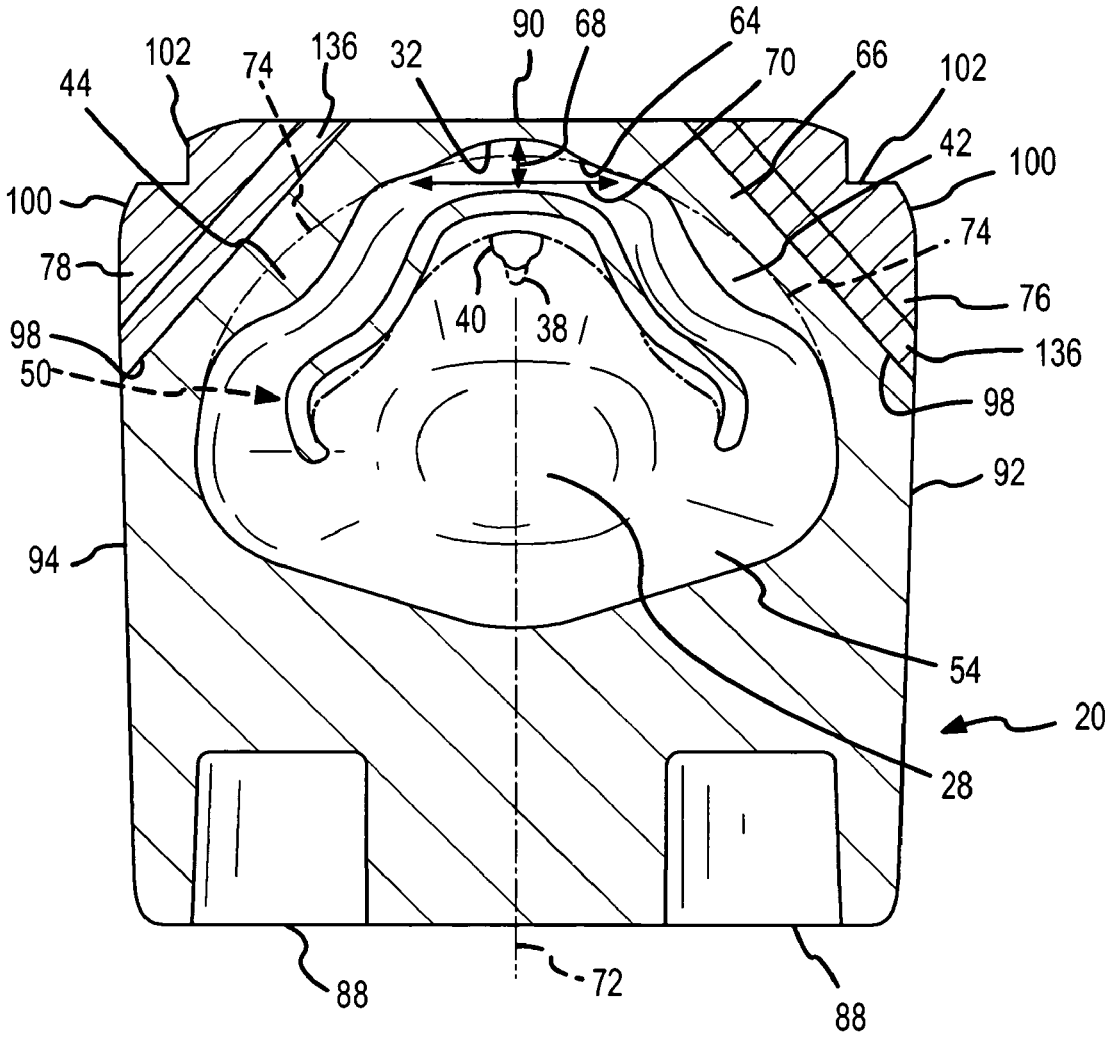
FIG. 8 is a transverse and substantially horizontal cross-sectional view taken substantially in the plane of line 8-8 of FIG. 4.

The support contour 26 also includes a recessed channel area 32 which extends vertically upward from the lowermost surface area 28 of the cavity 54 to an upper rear edge of the support contour 26, as shown in FIGS. 4 and 8. The channel area 32 is located on a rear wall 66 and extends downwardly and longitudinally forward from the rear wall 66 toward the lowermost surface area 28 of the cavity 54 at a transverse midline of the support contour 26, as shown in FIG. 8. The channel area 32 is positioned in the support contour 26 to be located directly behind the coccyx 38 and the sacrum 40 of the pelvic skeletal structure 50, when the user is seated in the cushion 20. The channel area 32 establishes a vertical and horizontal clearance 68 between the channel area 32 and the coccyx 38 and sacrum 40, as shown in FIG. 4. The channel area 32 also establishes a transverse clearance 70 which extends beyond each opposite lateral side of the coccyx 38 and sacrum 40, as shown in FIG. 8. The amount of the clearances 68 and 70 is sufficient to offload pressure and shear force from the skin surrounding the coccyx 38 and sacrum 40.

Figure 6:
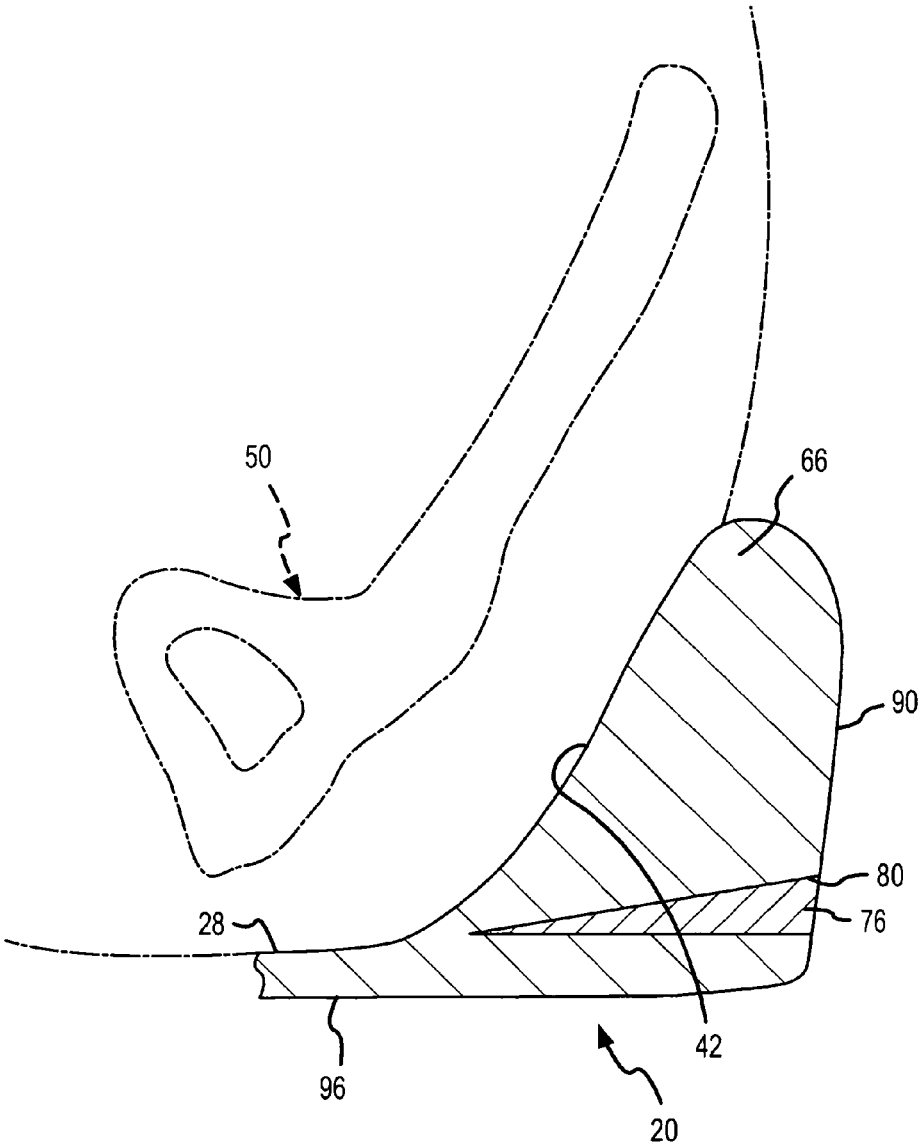
FIG. 6 is a vertical cross-sectional view of a portion of the support contour and skeletal structure shown in FIG. 3, taken substantially in the plane of line 6-6 of FIG. 3.

The support contour 26 includes the two support areas 42 and 44 which are located on the rear wall 66 in positions on opposite transverse sides of a longitudinal midline 72, as shown in FIGS. 2, 3 and 8. The support areas 42 and 44 extend forwardly from a midline contour line 74 (FIG. 8), and therefore provide more projections to create exaggerated pressure and support on the tissue and musculature at the posterior lateral buttocks of the pelvic area which is contacted by the support areas 42 and 44. As shown in FIG. 6, the support area 42 (the support area 44 is similar, but not shown in FIG. 6) generally curves vertically downwardly and transversely and longitudinally forwardly from an upper position on the rear wall 66 toward the lowermost surface area 28. The support areas 42 (and 44, not shown in FIG. 6) terminate vertically above the lowermost surface area 28. Oriented in this manner, the support areas 42 and 44 define forwardly and upwardly facing contact surfaces to contact the skin covering the tissue masses surrounding the pelvic bones 50 at the lateral posterior buttocks. The posterior lateral buttocks tissue and musculature are devoid of any underlying prominent bone structure. Instead, the considerable mass of posterior lateral buttocks tissue and musculature defines a relatively broad and substantial contact area which is able to accept and transfer the force into the pelvic skeletal structure which does not elevate the risk of developing pressure ulcers at those locations.

The upward component of curvature from the support areas 42 and 44 (FIG. 3) tends to induce an upward lifting force on the posterior/lateral pelvic area, which assists in offloading the pressure from the relief areas 28, 30 and 32. The lateral buttocks support areas 42 and 44 also provide lateral stability which helps retain the user in contact with the support contour 26 of the seat cushion 20. The lateral support stability is applied from the opposite sides of the rear portion of the users body, and thus tends to inhibit the user from tipping backward or to the side within the cushion. The support areas 42 and 44 bias or orient the pelvic area 50 in a slightly forward pivoted position (counterclockwise as shown in FIG. 4) to encourage the user to maintain his or her pelvic area 50 in a proper postural alignment position.

Figure 7:
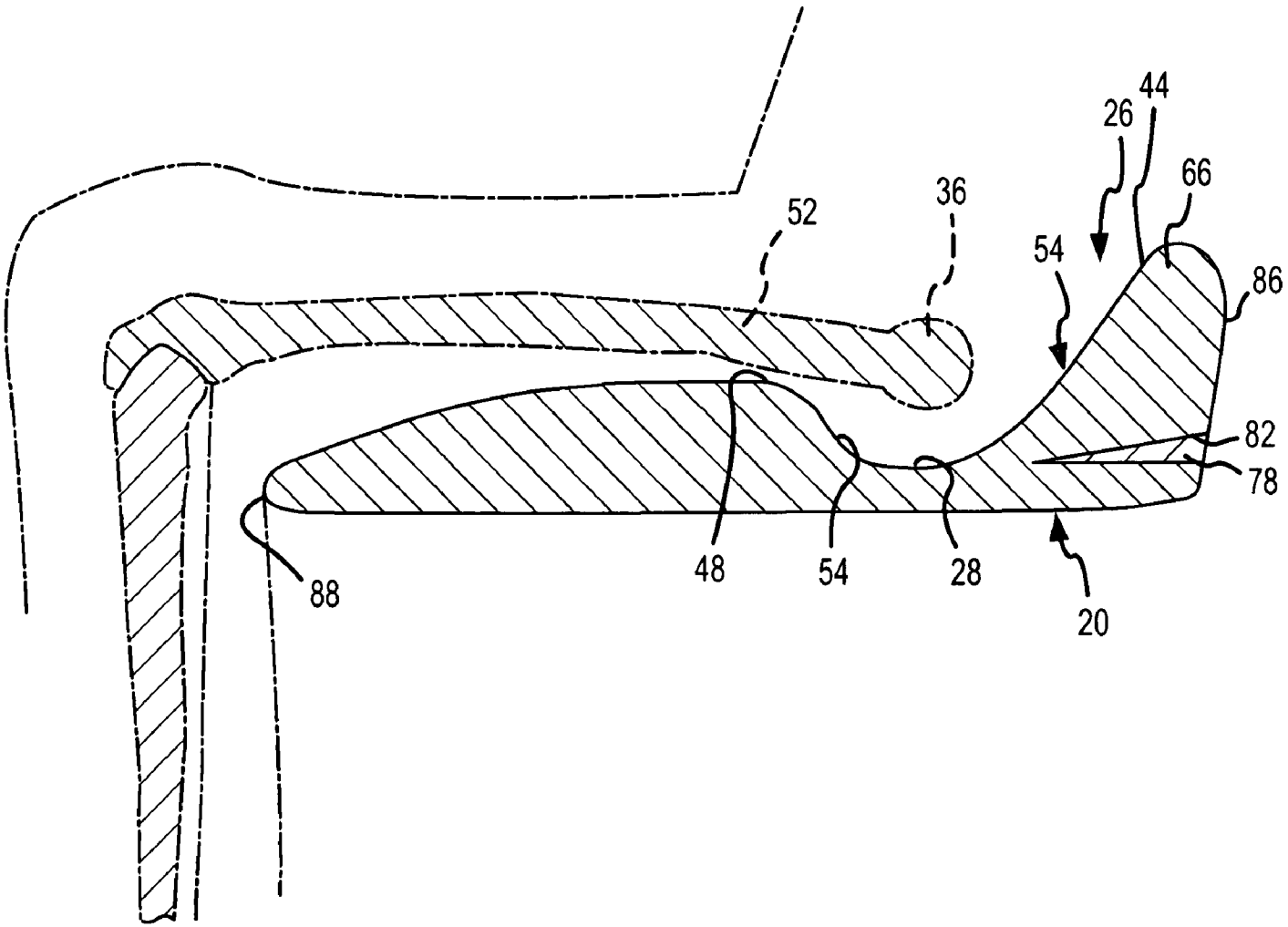
FIG. 7 is a longitudinal and vertical cross-sectional view taken substantially in the plane of line 7-7 of FIG. 3.

The support contour 26 also provides enhanced support from areas 46 and 48 which are located beneath the thigh bone 52 proximal to the greater trochanters 36, as shown in FIGS. 2, 3 and 7. The enhanced support areas 46 and 48 contact a relatively broad mass of tissue and muscle extending along the posterior thigh bone 52. The posterior thigh bone 52 extends generally longitudinally and has no prominences in the area where the support areas 46 and 48 contact the tissue surrounding the posterior thigh bones 52. The support areas 46 and 48 are able to transfer a relatively significant amount of pressure into the relatively broad mass of posterior thigh tissue and musculature to thereby support the skeletal structure.

The transfer of significant force into the posterior thigh tissue and musculature at the location of the support areas 46 and 48 complements the additional support from the areas 42 and 44 to maintain alignment for proper postural position of the pelvic area. The location of the support areas 42, 44, 46 and 48, as shown in FIG. 2, is approximately at four lateral and longitudinal positions surrounding the pelvic structure to facilitate holding the pelvic structure into a position of proper postural alignment and to stabilize the user when seated on the support contour.

By offloading pressure from the bony prominence areas 28, 30 and 32, and by applying the exaggerated support in the broad tissue and musculature areas 42, 44, 46 and 48, atrophy changes are less likely to have a significant negative impact. In general, the added clearance in the areas of the bony prominences provides an additional tolerance for tissue atrophy.

As described in the referenced U.S. patent application Ser. No. 10/628,860, the support contour 26 can be configured to fit the particular anatomical shape of a user. However, the support contour 26 is preferably configured with a standardized shape that is suitable to provide improved support characteristics for a range of users. In some circumstances it may be necessary to make adjustments to the support areas 42 and 44 of the support contour 26 to adapt a standardized support contour 26 to the individual anatomical shape of the user to achieve the maximum benefit. Moreover, because of changes which occur over time in the anatomical structure of the user, adjustments to the support contour 26 may be necessary at different times during the use of the seat cushion 20.

Figure 10:
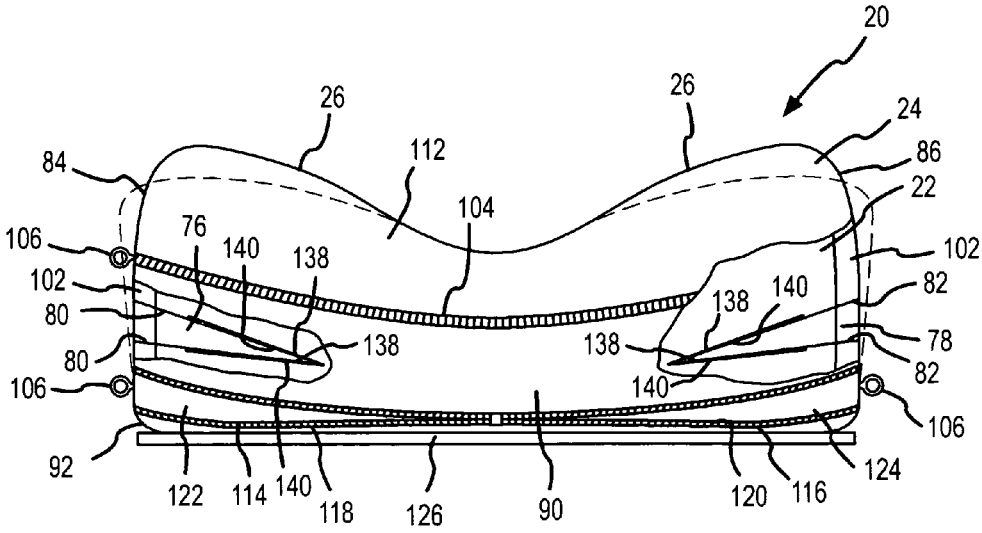
FIG. 10 is a rear elevation view of the seat cushion shown in FIG. 1, showing the cushion on a flat seat support structure of a wheelchair in an adjusted position shown by the solid lines as compared to the unadjusted position of the position illustrated by the dashed lines, with portions of the cover broken away to reveal the slits and insert members in both rear corners of the support structure.
Figure 11:
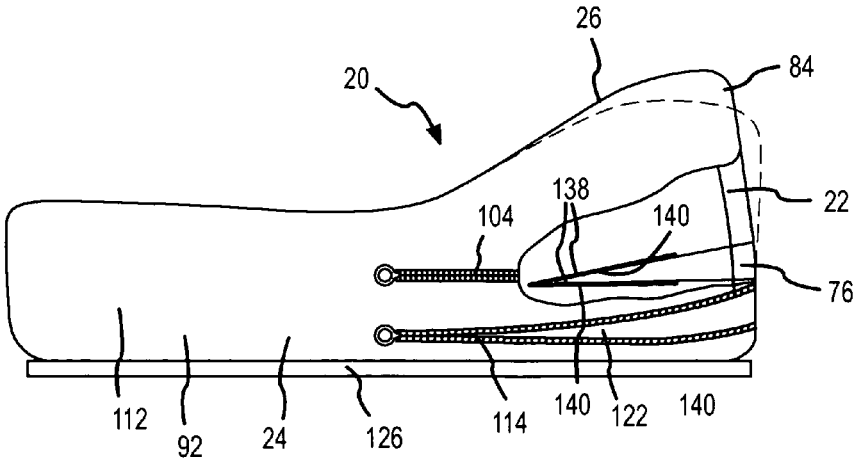
FIG. 11 is a side elevation view of the seat cushion shown in FIG. 10.
Figure 12:
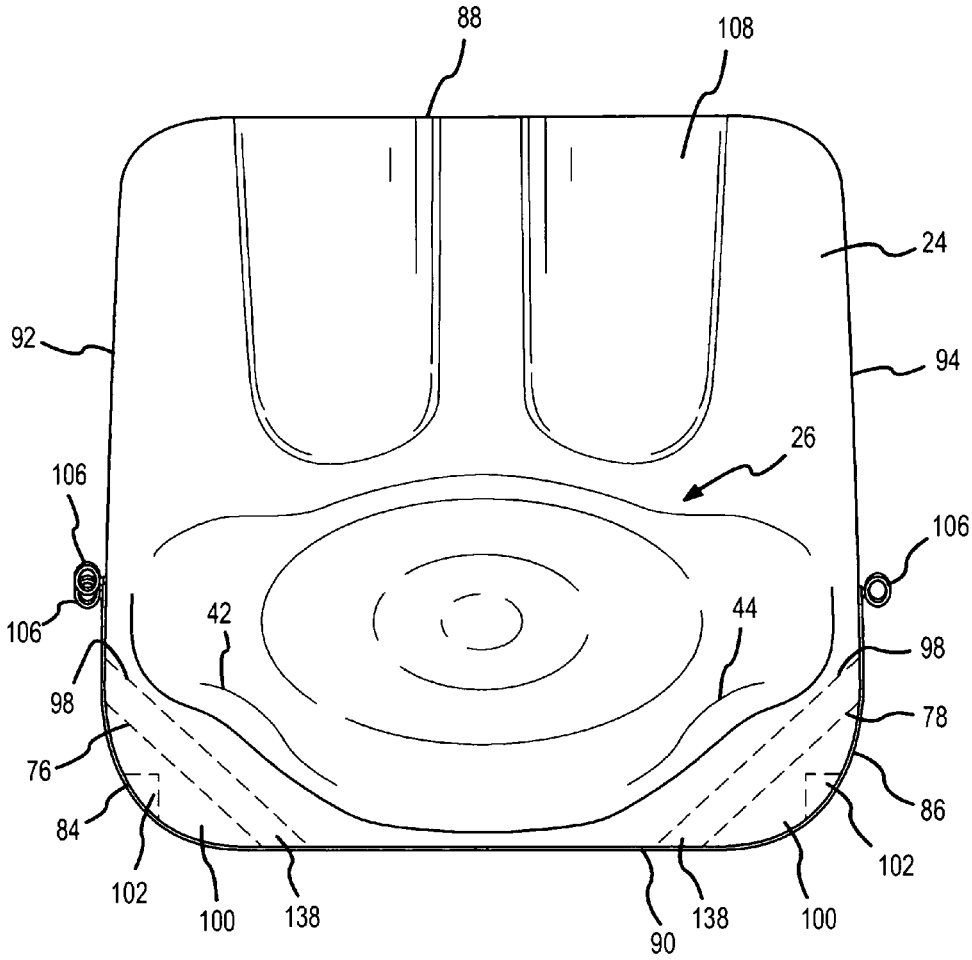
FIG. 12 is top plan view of the seat cushion shown in FIG. 10, with dashed lines also showing the position of the insert members within the support structure.

The present invention offers an improved capability to adjust the support areas 42 and 44 of the standardized support contour 26 of the seat cushion 20. As shown in FIGS. 1 and 9-13, adjustment of these support areas is accomplished by the insertion of one or more insertion members, such as wedges 76 and 78 into slits 80 and/or 82. The introduction of the wedges 76 and 78 forces the slits 80 or 82 open and thereby increases a vertical dimension of the support structure 22 in the locations of the wedges 76 and 78. The expansion of the support structure 22 in these locations, deforms the support structure 22 and changes the shape of the support contour 26. As shown in FIGS. 10 and 12, the insertion of a wedge 76 into each of the slits 80 and 82 causes the support areas 42 and 44 to move upward and transversely inward toward one another. The wedges 76 and 78, as shown in FIGS. 11 and 12, also move the support areas 42 and 44 longitudinally forward.

Changing the shape of the support contour 26 provides the ability to adjust the contour 26 to the particular needs of an individual user. By inserting one or more wedges 76, as shown in FIGS. 1 and 9-13, the positions of the support areas 42 and 44 are adjusted and the positions of the user's ischial tuberosities 34, greater trochanters 36, coccyx 38 and sacrum 40 relative to the support contour 22 of the seat cushion 20 are adjusted. Inserting wedges 76 and 78 in the slits 80 and 82 moves the support areas 42 and 44 relatively more forward and inward which causes an increase in the vertical clearance 56 between the ischial tuberosities 34 and the lower surface area 28 of the support contour 26 as well as an increase in the transverse clearance 60. The forward change in the position of the support areas 42 and 44 caused by the wedges 76 and 78 pushes the pelvic bones 50 forward to counteract the tendency of a user to slouch.

Figure 9:
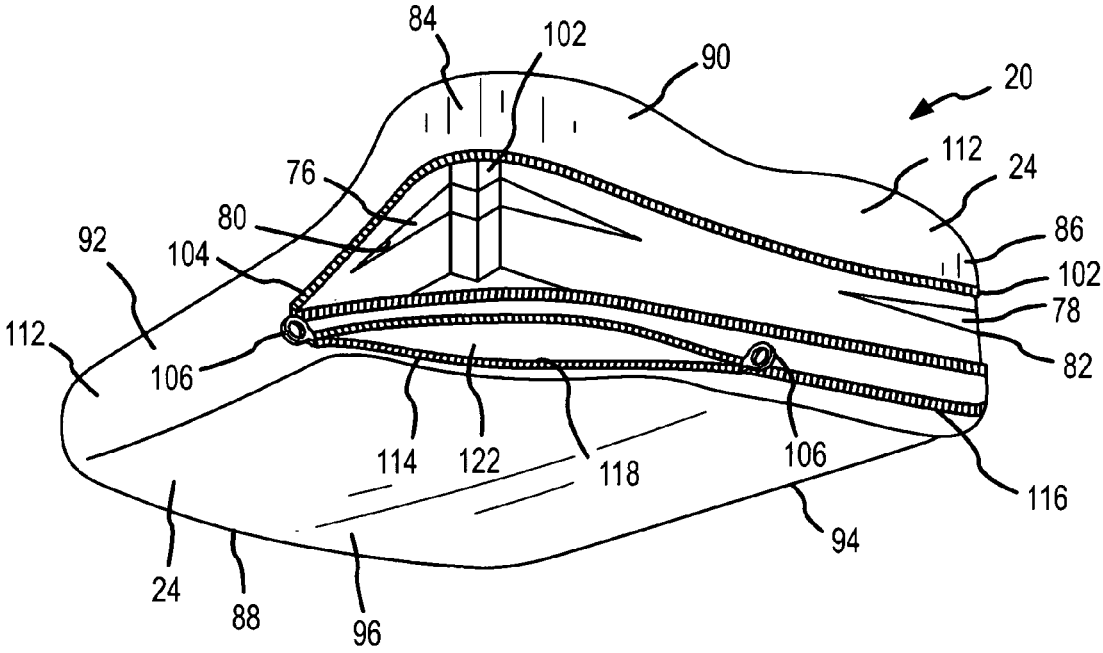
FIG. 9 is a lower perspective view of the contoured seat cushion shown in FIG. 1, shown with an access zipper open and the cover partially removed from the support contour to reveal the slit and the insert member.

The left and right slits 80 and 82 are preferably cut or formed into opposite transverse rear corners 84 and 86 of the support structure 22, as shown in FIG. 9. The left slit 80 extends from a rear transversely-extending side 90 of the seat cushion 20 to a longitudinally-extending left side 92 of the cushion (FIGS. 9 and 10) and the right slit 82 extends from the rear side 90 to a longitudinally-extending right side 94 of the cushion 20. The slits 80 and 82 extend in a plane that is generally parallel to a bottom surface 96 of the support structure 22. The slits 80 and 82 are generally triangularly shaped (FIG. 12) and resiliently open to receive the wedges 76 and 78 by resiliently deforming the portions of the support structure 22 above and below the slits 80 and 82.

The wedges 76 and 78, as shown in FIGS. 10 and 11, fit into the slits 80 and 82 with the thin edge facing inwardly toward the center of the support structure 22 and the relatively thick corner aligned with a corner of the support structure 22. When the wedge 76 is inserted in the slit 80, the wedge 76 is flush with the left side 92 and rear side 90 of the support structure 22. Similarly, when the wedge 78 is inserted in the slit 82, the wedge 78 is flush with the right side 94 and the rear side 90 of the support structure 22. The wedges 76 and 78 are retained in the slits 80 and 82 frictionally or by the use of hook and loop fasteners 138 and 140 and are also held in positioned by the cover 24.

The hook and loop fasteners 138 and 140 are preferably connected to the interior of the slits 80 and 82 and to the wedges 76 and 78, as shown in FIGS. 8 and 10-12. The slit includes a hook fastener 138 on one side and a loop fastener 140 on the opposite side. In this configuration, the slits 80 and 82 are held together and maintained against shear forces by the hook and loop fasteners 138 and 140 even when a wedge 76 and 78 is not inserted. The wedges 76 and 78 preferably have corresponding hook and loop fasteners 138 and 140 which align with the hook and loop fasteners 138 and 140 of the slits 80 and 82 when the wedges 76 and 78 are inserted.

The wedges 76 and 78 are preferably formed from a higher density or less compressible foam material than the material used for the support structure 22. The wedges 76 and 78 have a generally triangular shape in a plan view (FIG. 12) and have one edge 98 is relatively thin and an opposite corner 100 from the edge is thicker than the other corners, preferably about ½" to 1", although other wedge sizes can also be used. Inserting relatively larger wedges 76 and 78, or inserting more than one wedge 76 and 78 in a slit 80 and/or 82 causes relatively more articulation of the support areas 42 and 44 than is accomplished with a relatively smaller wedge 76.

Figure 13:
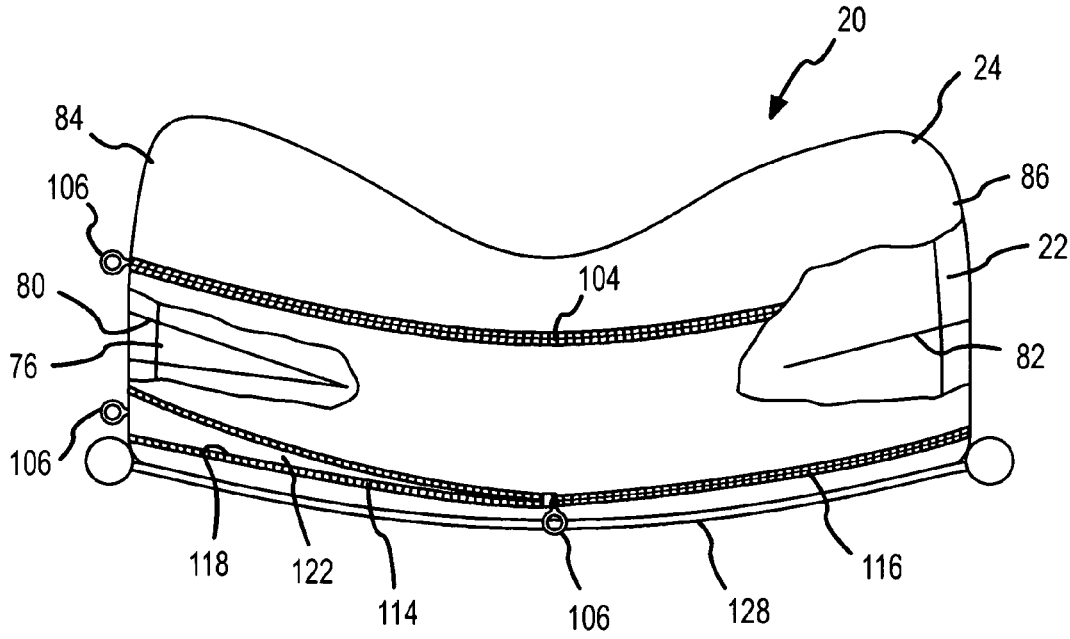
FIG. 13 is a rear elevation view of the seat cushion similar to that shown in FIG. 10, showing the cushion positioned on a sling type of seat support structure of a wheelchair and with a single insert member positioned in the slit in one corner and the other corner lacking an insert member.

In addition to providing the capability of adjusting the support contour 26 symmetrically by inserting equally-sized wedges 76 into each of the slits 80 and 82, the support contour 26 can also be adjusted asymmetrically, as shown in FIG. 13. Asymmetric adjustment is where one corner of the support structure 22 is articulated forward and inward more than the other corner of the support structure 22. In some circumstances a user's anatomy can atrophy on one side more than the other side. To accommodate this condition the support contour 26 can be adjusted asymmetrically by inserting more wedges 76 and 78, or a larger wedge 76 and 78 into one side, than the other side. This has the effect of articulating one of the support areas 42 or 44 relatively more upward, forward and transversely inward than the other one of the support areas 42 or 44 to contact the user's anatomy with both support areas 42 and 44.

As shown in FIGS. 9 and 10, the cover 24 includes an access zipper 104 to provide access to the slits 80 and 82 to insert and remove the wedges 76 and 78 and for inserting and removing the support structure 22 from the cover 24. The cover 24 has a continuous sidewall 112 which fits tightly along longitudinally-extending right and left sides 92 and 94, and around transversely-extending front and rear sides 88 and 90 of the support structure 22. A top portion 108 of the cover 24, as shown in FIG. 1, is positioned over the support contour 26. A bottom portion 110 of the cover 24 is positioned below the bottom surface 96 of the support structure 22. The top and bottom portions 108 and 110 attach to the sidewall 112 adjoining the longitudinally-extending right and left sides 92 and 94 and along the transversely-extending front and rear walls 88 and 90.

The access zipper 104 is connected between the bottom portion 110 of the cover 24 and the continuous sidewall 112. When the cover 24 is on the support structure 22, the zipper 104 extends from the rear of the longitudinally-extending left side 92 around the entire rear side 90 to the rear of the longitudinally-extending right side 94 of the support structure 22 (FIG. 1). The access zipper 104 also includes a handle 106 for opening and closing the zipper 104.

The sidewall 112 of the cover 24 includes expansion portions 114 and 116 having an expansion capability at the rear corners 84 and 86 to accommodate the expanded vertical dimension at the corners 84 and 86 when the wedges 76 and 78 are inserted in the slits 80 and 82 in the corners of the support structure 22. The expansion capability of the cover 24 allows the cover 24 to expand over the corners 84 and 86 when the wedges 76 and 78 are inserted, as shown in FIG. 10. In this way the cover 24 has the capability to enclose the support structure 22.

Left and right zippers 118 and 120 in the sidewall 112 are openable to provide the expansion capability by increasing a vertical dimension of the sidewall 112 at the corners 84 and 86. Gussets 122 and 124 are attached to the sidewall 112 adjacent to the upper teeth to the lower teeth of the zippers 118 and 120, respectively, to limit the increase in vertical dimension of the sidewall 112 when the zippers 118 and 120 are opened. The gussets 122 and 124 are folded into the interior of the cover 24 when the zippers 118 and 120 are closed. The gussets 122 and 124 are preferably made from the same material as the sidewall 112.

The zipper 118 and the gusset 122 extend from the left side 92 of the support structure 22 to the rear 90 of the support structure 22, and the zipper 120 and the gusset 124 extend from the right side 94 of the support structure 22 to the rear 90. The zippers 118 and 120 are conventional zippers that have pull handles 106 which slide in one direction to close the zipper 118 and 120 by securing the teeth in an upper half of the zipper to the teeth in a lower half of the zipper, and slide in another direction to open the zipper 118 and 120 by separating the teeth in the upper half from the teeth in the lower half of the zipper 118 and 120.

The zippers 118 and 120 preferably end at a point near the transverse center of the rear 90 of the support structure 22 so that a vertical dimension of the sidewall 112 at that location does not change regardless of whether the zippers 118 and 120 are opened or closed. Positioning the zippers 118 and 120 in this way ensures that the cover 24 remains taut in the transverse rear center of the support structure 22.

By keeping the cover 24 taut in the transverse rear center of the support structure 22, support areas 42 and 44 are maintained in a lateral dimension from one another before and while the user is seated. The tautness of the cover 24 in this area ensures that the insertion of the insertion members 76 and 78 into the slits 80 and 82 causes adjustment to the position of the support areas 42 and 44 rather than causing a change in the shape of the bottom surface 96.

The cover 24 helps the support structure 22 to maintain the position of the support areas 42 and 44 by fitting taut over the support structure 22. The sidewall 112 of the cover 24 fits tautly over the right and left sides 92 and 94 and the front and rear sides 88 and 90 of the support structure 22 to keep the front and rear sides of the support structure 22 from deforming away from one another. The sidewall 112 of the cover 24, including the expandable portions 114 and 116, fits tautly over the rear side of the support structure 22 and holds that portion of the support structure 22 from deforming backwardly.

The top portion 108 of the cover 24 is preferably made of a conventional spacer mesh material. The spacer mesh has a padding characteristic and is breathable without permitting substantial stretching in either a longitudinal or transverse direction. The remaining bottom portion 110 of the cover 24 is preferably made of a substantially non-stretchable nylon material that is also breathable and which covers the seat support structure 22 other than the support contour 26. The sidewall 112 is also made of non-stretchable breathable nylon material. Since the top, bottom and sidewall portions of the cover 24 are non-stretchable, the cover 24 resists outward deflection of the sides 88, 90, 92 and 94 of the support structure 22. In this way the non-stretchable characteristic of the cover 24 assists in maintaining the shape of the support contour 26 even when the wheelchair user is seated on the cushion 20.

The support structure 22 has a bottom surface 28 with a generally convex shape, as shown in FIG. 9, that curves slightly between the left and right sides 92 and 94. The shape of the bottom surface 28 is a compromise between a flat or planar shape that complements a flat seat support structure 126 (FIG. 10) of some types of wheelchairs and a generally downward convex shape with a larger curve that complements a sling type seat support structure 128 (shown in FIG. 13) of other types of wheelchairs.

When the cushion 20 is placed on a flat seat support structure 126 (FIG. 10) the cushion 20 tends to flatten out to conform to the seat support structure 126, and in doing so, the support areas 42 and 44 will generally move away from one another. In order to compensate for this change in the support contour 26, the wedges 76 and 78 may be inserted to move the support areas 42 and 44 relatively closer to one another. On the other hand, when the cushion 20 is placed on a sling type seat support structure 128, FIG. 13, the cushion 20 tends to assume a more curved shape to match the seat support structure 128. In this instance, the support areas 42 and 44 are articulated closer to one another by the downwardly convex curve of the cushion 20. Because of this articulation, the cushion 20 may be utilized for some individuals without the addition of wedges 76.

The support structure 22 and the wedges 76 and 78 preferably have a generally vertically aligned rear channels 102 that allow conventional upright bars (not shown) of the wheelchair to be positioned in the corners of the cushion 20. The cover 24 fits over the rear channels 102 but allows the bars to push into the channels 102 when the cushion 20 is positioned on the wheelchair. Positioning the cushion 20 on the wheelchair in this way also has the effect of retaining the wedges 76 positioned in the slits 80 and 82.

As described in the above-referenced U.S. patent application Ser. No. 10/628,890, support and pressure relief characteristics of the support contour 26 can be determined and adjusted by the technique using an impression foam or clearance measuring device 130. The clearance measuring device 130 allows a therapist to determine whether the users bony prominences have adequate clearance from the surface of the cushion 20. This provides the therapist with information that is used to determine the degree of adjustment needed, if any, to fit the cushion 20 to a particular user.

Figure 14:
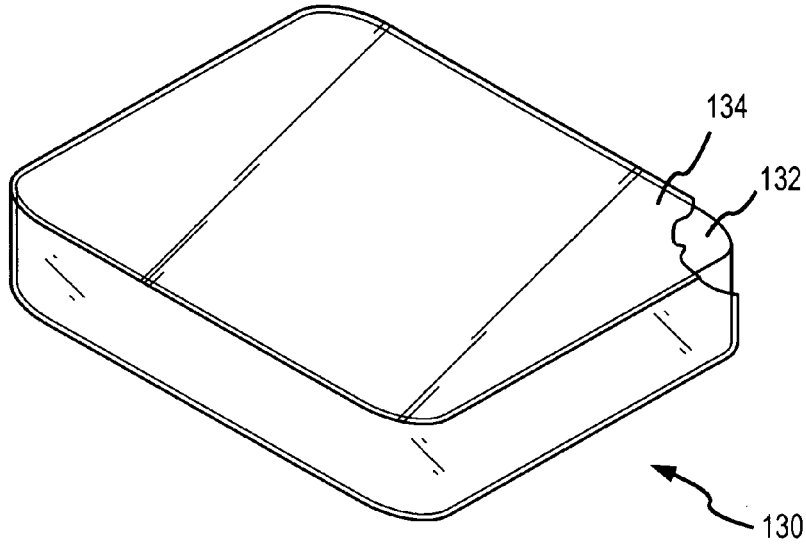
FIG. 14 is a perspective view of one embodiment of a clearance measuring device for use with the seat cushion shown in FIG. 1, with a portion broken away.

The clearance measuring device 130, shown in FIG. 14, is used in accordance with the present invention to measure the clearance between the contacting portion of the individual's anatomy and the support contour 26 of the seat cushion 20 (FIG. 1). The clearance measuring device 130 comprises a pad 132 of collapsible impression foam confined within a clear flexible envelope 134. The foam pad 132 generally has a longitudinal and transverse horizontal dimensions (as shown in FIG. 14) which are sufficient to cover each of the areas 28, 30 or 32 of the support contour 26 (FIG. 2) in which clearance is provided to offload pressure and shear forces from the anatomy in those areas. However, the longitudinal and transverse horizontal dimensions (as shown in FIG. 14) may also be sufficient to cover only a portion of one of the areas 28, 30 and 32 (FIG. 2). The vertical thickness dimension (as shown in FIG. 14) of the foam pad 132 is approximately the thickness necessary to achieve a desired degree of collapse of the impression foam, but not to fully collapse the impression foam, when the device 130 is used.

Figure 15:
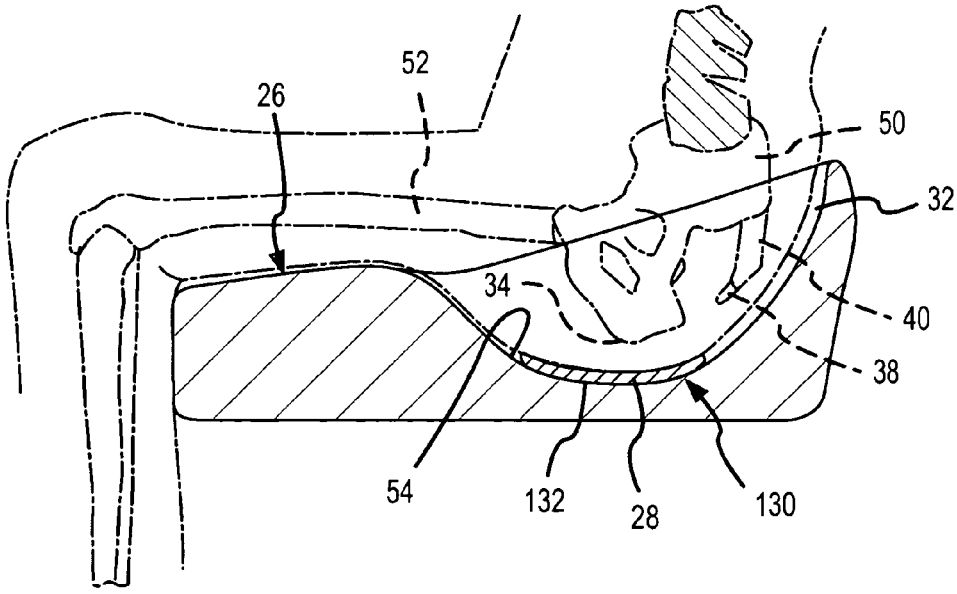
FIG. 15 is a midline longitudinal and vertical cross-sectional view taken substantially in the plane of line 4-4 of FIG. 3, showing use of the clearance measuring device shown in FIG. 14.
Figure 16:
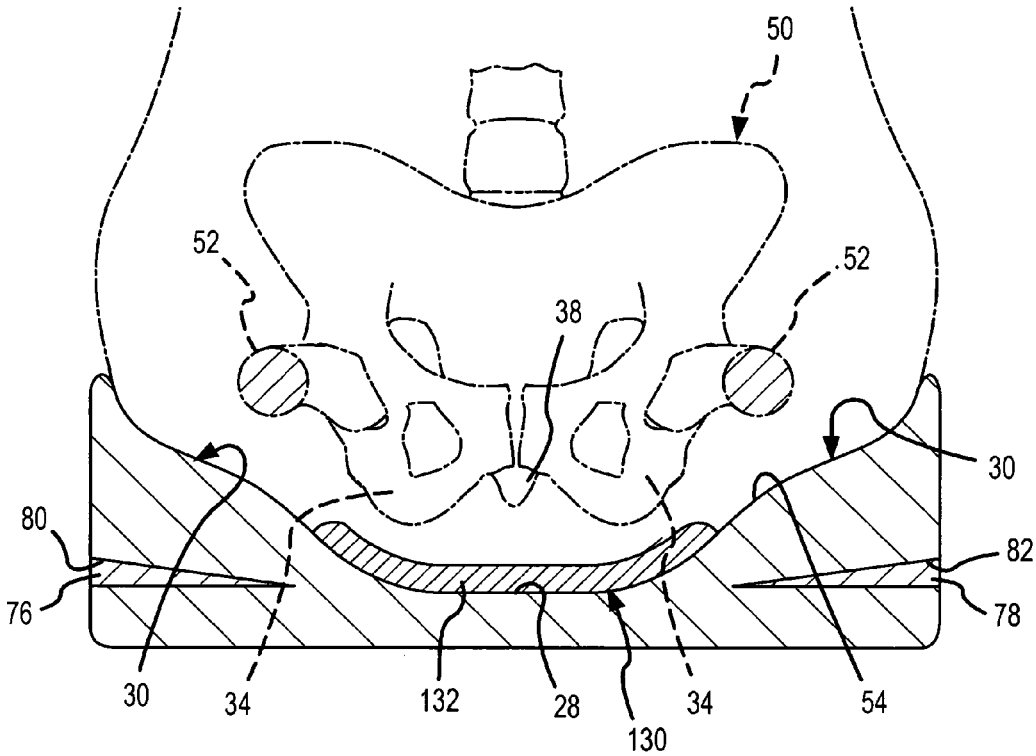
FIG. 16 is a transverse and vertical cross-sectional view taken substantially in the plane of line 5-5 of FIG. 3, showing use of the clearance measuring device shown in FIG. 14.

The clearance measuring device 130 is used as shown generally in FIGS. 15-16. The device 130 is placed at a desired location on the support contour 26 where a clearance is to be measured. In the case of the support contour 26 shown in FIG. 2, the device would normally be placed to cover all or part of one of the areas 28, 30 or 32 where a clearance has been configured into the support contour 26 to offload pressure and shear forces from the user's anatomy. As an example, shown in FIGS. 15 and 16, the device 130 has been placed at the bottom of the cavity 54 on the lowermost surface area 28. After the device 130 is placed at the desired location, the user sits down or otherwise contacts the support contour 26 in the normal manner with the device 130 positioned between the user's anatomy and that portion of the support contour 26 where the clearance is to be measured. For example, as shown in FIGS. 15 and 16, the user has seated himself or herself on the support contour 26 with the device positioned at the lowermost surface area 28. The user's ischial tuberosities 34 and the surrounding tissue contacts the device 130 and compresses the foam pad 132. Collapse, indention or compression of the foam pad 132 occurs to an extent indicating the amount of clearance between the tissue surrounding the ischial tuberosities 34 and the lowermost surface area 28 of the support contour 26.

The cushion 20 can be supplied to a therapist in a seat cushion adjusting kit along with the clearance measuring device 130 and an assortment of wedges 76 and 78 of various sizes. By placing the cushion on the wheelchair and the clearance measuring device 130 on the cushion 20 before seating the user on the cushion, the therapist is able to determine if the cushion 20, as it is currently configured, is suitable to provide proper postural alignment and pelvic support for the user. If the bony prominences of the seated user are too close to the surface of the support contour 26, or other conditions exist where the support contour 26 is not configured correctly for the user, then the therapist can open the access zipper 104 and insert one or more wedges 76 and/or 78 into one or both of the left or right slits 80 or 82 to adjust the position of the support areas 42 and/or 44 so that more support is provided by these areas to support the user.

The kit makes it possible for the therapist to stock only one cushion to fit a variety of different users, which saves storage space and eliminates confusion over selecting one of many seating solutions. The adaptability of the cushion 20 provides the therapist with a broader range of applicability than is available with some other seating devices. The inclusion of the clearance measuring device 130 and the wedges 76 and 78 along with the cushion 20 provides that therapist with the necessary tools to adjust the cushion 20 to benefit users with a variety of anatomical configurations. The adjustable nature of the cushion 20 allows the cushion 20 to be adjusted to fit the user over a period of time past when conventional non-adjustable cushions must be replaced because of changed user anatomical features or the onset of physical deterioration.

The cushion 20 is preferably less than two pounds in weight which is believed to be half of the weight of any other cushion currently on the market. The reduced weight of the cushion 20 makes it an ideal candidate for self-propelled wheelchair where weight is an issue. The cushion 20 is also ideal for use by wheelchair athletes because of the support given by the cushion 20 over a range of movements of the pelvic area 50 and because of the light weight of the cushion 20.

The cover 24, as well as the support structure 22, are made of material that allows air flow around the tissue of the user. This feature is important in the prevention of pressure ulcers since increased temperature and the retention of moisture next to the skin can cause increased stress on the user's skin.

The cover 24 is also removable from the support structure 22 so that the cover 24 can be washed in a conventional washing machine. The support contour 22 and the wedges 76 can be rinsed off with running water since the material of the support contour 22 and the wedges 76 do not absorb or retain water. The washable nature of the cushion 20 is especially of benefit to a user who is suffering from problems with incontinence.

The cost of the cushion 20 to the user is relatively inexpensive in comparison to some other cushions. This is due to the relatively inexpensive nature of the materials used to manufacture the cushion 20 and the reduced number of hours to produce the cushion 20 because of the simple yet elegant design. Many other advantages and improvements will be apparent after gaining a full appreciation of the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

What is claimed is:

1. A contoured seat cushion for supporting a person in a seated position thereon, the person having a pelvic area with bony prominences and tissue masses spaced from the bony prominences, the tissue masses including posterior lateral buttocks, comprising:

a support structure made from a resilient material, the support structure including generally opposite front and rear sides, generally opposite left and right sides, a bottom surface extending between the front and rear sides and between the left and right sides, and a top surface generally opposite of the bottom surface and extending between the front and rear sides and the left and right sides;

the top surface configured as a support contour defining relief areas and support areas, the relief areas positioned to align with the bony prominences of a person when the person is seated on the cushion, and the support areas positioned to align with the tissue masses of the posterior lateral buttocks;

an insertion member;

openings formed in each of the rear corners between the top surface and the bottom surface of the support structure to receive the insertion member, the openings positioned between the top surface and the bottom surface, and a support area of the support contour changing position relative to other support areas or relief areas when the insertion member is inserted into one of the openings;

a cover made from a substantially non-stretchable material, the cover sized to encase the support structure to resist substantial outward deformation of the support structure when the person is seated on the seat cushion; and an expansion portion of the cover positioned adjacent to the rear corner to expand the cover at the corner to fit around the support structure when the insertion member is inserted in the opening, the expansion portion including a zipper and a gusset, the zipper opening to allow the gusset to expand, and the zipper closing to contract the gusset.

2. A method of manufacturing a contoured seat cushion as defined in claim 1, comprising:

forming the support structure to include the generally opposite front and rear sides, the generally opposite left and right sides, the bottom surface and the top surface;

configuring the top surface as the support contour with the relief areas and the support areas;

forming the opening in each of the rear corner of the support structure, each opening adapted to receive the insertion member to articulate the support areas aligned with the tissue masses at the posterior lateral buttocks foward and laterally inward;

encasing the support structure within the cover with the expansion portion positioned adjacent to the rear corner;

inserting the insertion member into the opening; and expanding the cover at the expansion portion to accommodate an increased dimension of the support structure caused by the insertion of the insertion member into the opening.

3. A method as defined in claim 1, further comprising:

shaping the insertion member substantially as a wedge.

4. A method as defined in claim 1, further comprising:

forming the bottom surface as a convex shape that curves between the left side and the right side.

5. A method of adjusting a contoured seat cushion as defined in claim 1 to support a person in a seated position on the support structure, comprising:

inserting the insertion member into the opening in the corner of the support structure;

adjusting a position of the support area of the support contour by inserting the insertion member into the opening;

restraining the support structure and the support area against outward deformation away from the pelvic area by surrounding the support structure with the cover; and expanding a portion of the cover to fit over the support structure after the insertion member has been inserted.

6. A contoured seat cushion for supporting a person in a seated position thereon, the person having a pelvic area with bony prominences and tissue masses spaced from the bony prominences; the bony prominences of the pelvic area include the ischial tuberosities, the greater trochanters and the coccyx and sacrum; the tissue masses of the pelvic area include the tissue masses on opposite lateral sides of the posterior buttocks and beneath the proximal thigh bones; the cushion comprising:

a support structure made from a resilient material, the support structure including generally opposite front and rear sides, generally opposite left and right sides, a bottom surface extending between the front and rear sides and between the left and right sides, and a top surface generally opposite of the bottom surface and extending between the front and rear sides and the left and right sides; and wherein:

the top surface is configured as a support contour defining relief areas and support areas; the support areas and relief areas are separate from one another; the relief areas are positioned to align with the bony prominences of a person when the person is seated on the cushion, support areas are positioned to align with the tissue masses of the posterior lateral buttocks; the support areas are at locations adapted to be adjacent to skin at the tissue masses on the opposite lateral sides of the posterior buttocks and beneath the proximal thigh bones; the relief areas are at locations adapted to be adjacent to skin covering the ischial tuberosities, the greater trochanters and the coccyx and sacrum; and the support areas and the relief areas are spaced relatively more toward and relatively more away from the anatomical shape of the pelvic area of the person when the person is seated on and supported by the support contour; and wherein the cushion further comprises:

an insertion member; and openings to receive the insertion member, the openings formed in each of the rear corners between the surface and the bottom surface of the support structure, the opening positioned between the top surface and the bottom surface, and wherein:

at least one support area of the support contour changing position relative to other support areas and relief areas when the insertion member is inserted into one of the openings.

7. A contoured seat cushion as defined in claim 6, wherein:

the cushion extends longitudinally from a rear wall at the rear side to the front side and extends transversely between opposite transverse sides, each transverse side extends longitudinally between the rear wall and the front side, and the rear wall has a general midline contour which represents the anatomical shape of a rear portion of the pelvic area of the person;

the support contour is defined relative to a longitudinal midline which extends midway between the opposite transverse sides, and is further defined relative to the horizontal and the vertical, the horizontal having a component which extends longitudinally and transversely and the vertical having a component which extends perpendicular to the horizontal;

the support contour includes a cavity forward of the rear wall and extending downward to a lower surface which is adapted to be located beneath the isohial tuberosities when the person is seated on and supported by the support contour;

the lower surface of the cavity constituting an ischial tuberosities relief area which is spaced from the isohial tuberosities to substantially offload pressure and shear force from the skin adjacent to the ischial tuberosities when the person is seated on and supported by the support contour;

the support contour includes two transverse relief areas spaced transversely to the outside of the cavity and which are adapted to be located beneath the greater trochanters when the person is seated on and supported by the support contour, each transverse relief area is spaced vertically above the lower surface of the cavity;

the transverse relief areas each constituting a greater trochanter relief area which is spaced from each greater trochanter to substantially offload pressure and shear force from the skin adjacent to the each greater trochanter when the person is seated on and supported by the support contour;

the support contour includes a channel in the rear wall at a location approximately centered transversely about the longitudinal midline and recessed rearward into the rear wall relative to the midline contour of the rear wall, the channel is adapted to be located behind and transversely to the sides of the coccyx and the sacrum when the person is seated on and supported by the support contour;

the channel constituting a coccyx and sacrum relief area which is spaced sufficiently from the coccyx and sacrum to substantially offload pressure and shear force from the skin adjacent to the coccyx and sacrum when the person is seated on and supported by the support contour;

the support contour including two rear support areas located on the rear wall on respectively opposite transverse sides of the longitudinal midline and between the channel and the greater trochantors relief areas, each rear support area protruding forward relative to the midline contour of the rear wall, each rear support area is adapted to be located adjacent to the skin and tissue masses on opposite lateral sides of the posterior buttocks when the person is seated on and supported by the support contour;

the rear support areas each constituting lateral posterior buttocks support areas which induce upward support pressure on the opposite lateral sides of the posterior buttocks when the person is seated on and supported by the support contour;

two forward support areas located forward of the cavity and spaced transversely on opposite sides of the longitudinal midline, each forward support area located vertically higher than the greater trochanters relief areas, the forward support areas are adapted to be located beneath the proximal thigh bones at a position which is closer to the greater trochanters compared to the location of knee joints on the thigh bones when the person is seated on and supported by the support contour;

the forward support areas constituting proximal thigh support areas which induce upward support pressure while interacting in a fulcrum-like manner with the proximal thigh bones to create elevational force at the hip joints from weight of the distal legs to elevate the greater trochanters relative to the greater trochanter relief areas when the person is seated on and supported by the support contour; and the upward support pressure induced from the lateral posterior buttocks support areas and from the proximal thigh support areas transferring substantially the entire support pressure to tissue masses on opposite lateral sides of the posterior buttocks and beneath the proximal thigh bones while substantially offloading support pressure from skin covering the ischial tuberosities and the greater trochanters and the coccyx and sacrum when the person is seated on and supported by the support contour.

8. A contoured seat cushion as defined in claim 7, wherein:

the locations of the proximal thigh support areas establish a lever-like mechanical advantage for increasing the amount of elevational force at the hip joints from the weight of the distal legs.

9. A contoured seat cushion as defined in claim 7, wherein:

the channel has a V-shaped curvature of increasing transverse width with increasing vertical height above the lower surface of the cavity.

10. A contoured seat cushion as defined in claim 7, wherein:

the support pressure from the lateral posterior buttocks support areas prevents the pelvic area from tipping backward in response to the elevational force at the hip joints.

11. A contoured seat cushion as defined in claim 7, wherein:

the upward support pressure induced from the rear support areas and from the proximal thigh support areas also facilitate postural alignment and stabilization of the pelvic area against forward and backward and lateral side to side movement when the person is seated on and supported by the support contour.

12. A contoured seat cushion as defined in claim 7, wherein:

the isohial tuberosities relief area and the greater trochanters relief areas and the coccyx and sacrum relief area are of sufficient size to offload pressure from the skin covering the ischial tuberosities and the greater trochanters and the coccyx and sacrum during normal forward and backward pivoting movement of the pelvic area and an upper torso of the person when seated on and supported by the support contour.

13. A contoured seat cushion as defined in claim 7, wherein:

the support contour includes a clearance area extending upward and forward from the lower surface of the cavity and approximately centered about the longitudinal midline, the clearance area adapted to be located adjacent to a perineal area of the person when seated on and supported by the support contour, the clearance area establishing space for air circulation at the perineal area.

14. A contoured seat cushion as defined in claim 13, wherein:

the integral piece of support material comprises a matrix of resilient adhered-together plastic beads having spaces between the beads to establish permeability for air movement within the integral piece of support material.

15. A contoured seat cushion as defined in claim 14 for use on a wheelchair.

16. A method of adjusting a contoured seat cushion as defined in claim 6 to support a person in a seated position on the support structure, comprising:

inserting the insertion member into the opening in the corner of the support structure; and adjusting a position of the support area of the support contour by inserting the insertion member into the opening.

* * * * *